United States Patent [19]

Cholin

[11] Patent Number: 4,513,202

[45] Date of Patent: Apr. 23, 1985

[54] SELF COMPENSATING FIRE DETECTION DEVICE

[75] Inventor: John M. Cholin, Hackensack, N.J.

[73] Assignee: Firetek Corporation, Hawthorne, N.J.

[21] Appl. No.: 378,090

[22] Filed: May 14, 1982

[51] Int. Cl.[3] ..... G08B 17/10; H01J 47/02

[52] U.S. Cl. ..... 250/385; 250/381

[58] Field of Search ..... 250/381, 382, 384, 385, 250/389; 340/639

[56] References Cited

U.S. PATENT DOCUMENTS

| | | | |
|---|---|---|---|
| 3,913,082 | 10/1975 | Hamm | 250/381 |
| 4,185,196 | 1/1980 | Byrne | 250/381 |
| 4,213,047 | 7/1980 | McCord | 250/385 |

*Primary Examiner*—Alfred E. Smith
*Assistant Examiner*—Carolyn E. Fields
*Attorney, Agent, or Firm*—W. Patrick Quast

[57] ABSTRACT

A device employing ionization principles for fire detection disclosing a configuration which allows compensation for adverse effects due to the flow of the gas through the device or due to the accumulation of dust and dirt therein. The detecting device includes two ionization chambers, each having a first member, such as a cylindrically shaped cup, having first and second conductive surface portions. Each chamber also includes a second member, such as a circular, electrode disc having two conductive surface portions. There is disposed in each chamber a radioactive source for ionizing the gas in the volumes intervening between respective pairs of surfaces. The area dimensions of the respective pairs of surfaces, the intervening volumes and the distances there between, and the relative orientation of the respective pairs are calculated and placed such that the ionization currents flowing between pairs of conductive surfaces are substantially equal and orthogonal to each other.

8 Claims, 3 Drawing Figures

SELF COMPENSATING FIRE DETECTION DEVICE

BACKGROUND OF THE INVENTION

This invention pertains to the field of fire detection devices, and in particular to a device employing the ionization principle of detection.

DESCRIPTION OF THE PROBLEM

Fire detection devices using the ionization principle typically detect the presence of combustion particles by noting a change in an electric current created in the chamber. The current is developed in an ionization chamber using a small radioactive source. The chamber is made of two metallic electrodes, one of which contains the source of ionizing radiation. The ionizing radiation bombards the air within the chamber and in doing so strips some air molecules of their electrons and of course generates free electrons. The ions migrate through the air, and since they have an electrical charge, a minute electric current is established on the order of twenty to one hundred picoamperes. As smoke particles enter the ionization chamber through a general Brownian movement, they affect the number and mobility of the air ions, thus affecting the chamber current. The change in current is detected by an ultra high input impedance amplifier and appropriate warnings given.

The state of the art has developed to the point where most ionization type units use two chambers; one reference chamber and one sample chamber. These two chambers are typically connected in a series electrical circuit so that changes in the sample chamber can be measured as changes in voltage at the electrical point between the two chambers. In addition to simplifying the measurement circuitry, the use of the reference chamber compensates for changes in air temperature, pressure and humidity. All three affect the current in an ionization chamber.

Nevertheless, since the sample chamber must be open to the ambient air in order to have access to the smoke, it is vulnerable to two other sources of spurious changes in chamber current. These are the accumulation of dust inside the chamber and the effect of air movement through the chamber. Since both of these change the current level in the ionization chamber they can affect the sensitivity of the device to the extent of causing false alarms; or, simply, fail to detect nominal concentrations of smoke in the air. In order to cope with these short comings the fire protection industry has adopted complicated zoning of detection circuits, increased numbers of detectors, and complicated service regimens to keep units clean.

The sensitivity of the detector to air movement and dust stems from the internal geometry of the chamber. There have been two types of geometries used. The first is a pin surrounded by a concentric cylinder. In this chamber design the flow of current radiates from the central pin out to the surrounding chamber wall. The charge density is evenly distributed and the calculation for current density is relatively easy to do. The chamber current is determined by the ion life-time, the speed with which the ions move, and the distance they must travel. If the life-time and distance remain the same then an increase in the speed of the ions will increase the current. Consequently, it will take more smoke to cause an alarm. Thus when air blows across the chamber, perpendicular to the axis of the chamber but parallel to the flow of current, it augments the chamber current.

If the air movement is parallel to the axis of the chamber then the ions are blown sideways and hence their current path is longer. Increasing the distance means that fewer ions survive long enough to reach the other electrode and consequently the current is drastically reduced. This chamber current reduction leads to a false alarm.

The second chamber geometry is essentially two parallel plates with the radioactive source ionizing the air between the plates. Here again the calculations of ionization current are easy because of the fact that this geometry has the same electro-static equation as the traditional parallel plate capacitor. This chamber geometry also has problems with air movement. The movement of the air parallel to the surface of the plates increases the distance the ionized air must travel and hence reduces the current, causing a false alarm. Also the accumulation of dust and dirt on either of the typically horizontal plate surfaces tends to impede the movement of the ions on to the electrode plate and, consequently, reduces current flow. This reduction in current flow will eventually lead to a false alarm.

These two mechanisms of false alarm limit the areas of application for the traditional ionization detector. Areas where the air movement is high or where there is dust and dirt in the environment tend to precipitate so many false alarms that the devices can not be used.

Therefore, it is primary object of this invention to provide an ionization detector which compensates for alterations in current flow due to air movement and dust collection, whereby adequate fire protection can be provided in these environments.

SUMMARY OF THE INVENTION

Towards the accomplishment of this and other objectives which will become apparent from a reading of the accompanying description of the preferred embodiment, and studying of the drawings, a device is described employing ionization principles, for responding to alterations in the condition of a gas medium in which the device is placed, which device includes self compensating features for the effects of gas flow through the device and the accumulation of dirt and dust. The device includes first and second ionization chambers, typically disposed within an outer housing. Each chamber includes a first member which has first and second conductive surface portions; and, a second member having third and fourth conductive surface portions which co-act with the first and second conductive surface portions. Disposed in each chamber is a radioactive source for ionizing the gas medium in the chambers and particularly the intervening volumes between the co-acting, conductive surface portions. The area dimensions of the respective pairs of conductive surface portions, the respective intervening volumes and distances there between, and the relative orientation of the respective pairs are calculated and placed such that the respective ionization currents in each of the two chambers are substantially equal and orthogonal to each other. Of course, one of the chambers, referred to as the sample chamber, as well as the outside housing, includes adequate openings to enable the surrounding gas medium to enter that chamber and pass through the volumes intervening between respective pairs of the conducting surfaces.

The preferred embodiment discloses a device suitably adapted for fire protection, but the breadth of application of the particular principles of the invention extend beyond the fire detection area.

BRIEF DESCRIPTION OF THE DRAWINGS

A better understanding of the disclosed invention will follow from a consideration of the accompanying drawings which include.

DESCRIPTION OF THE PREFERRED EMBODIMENT

Figure 1:
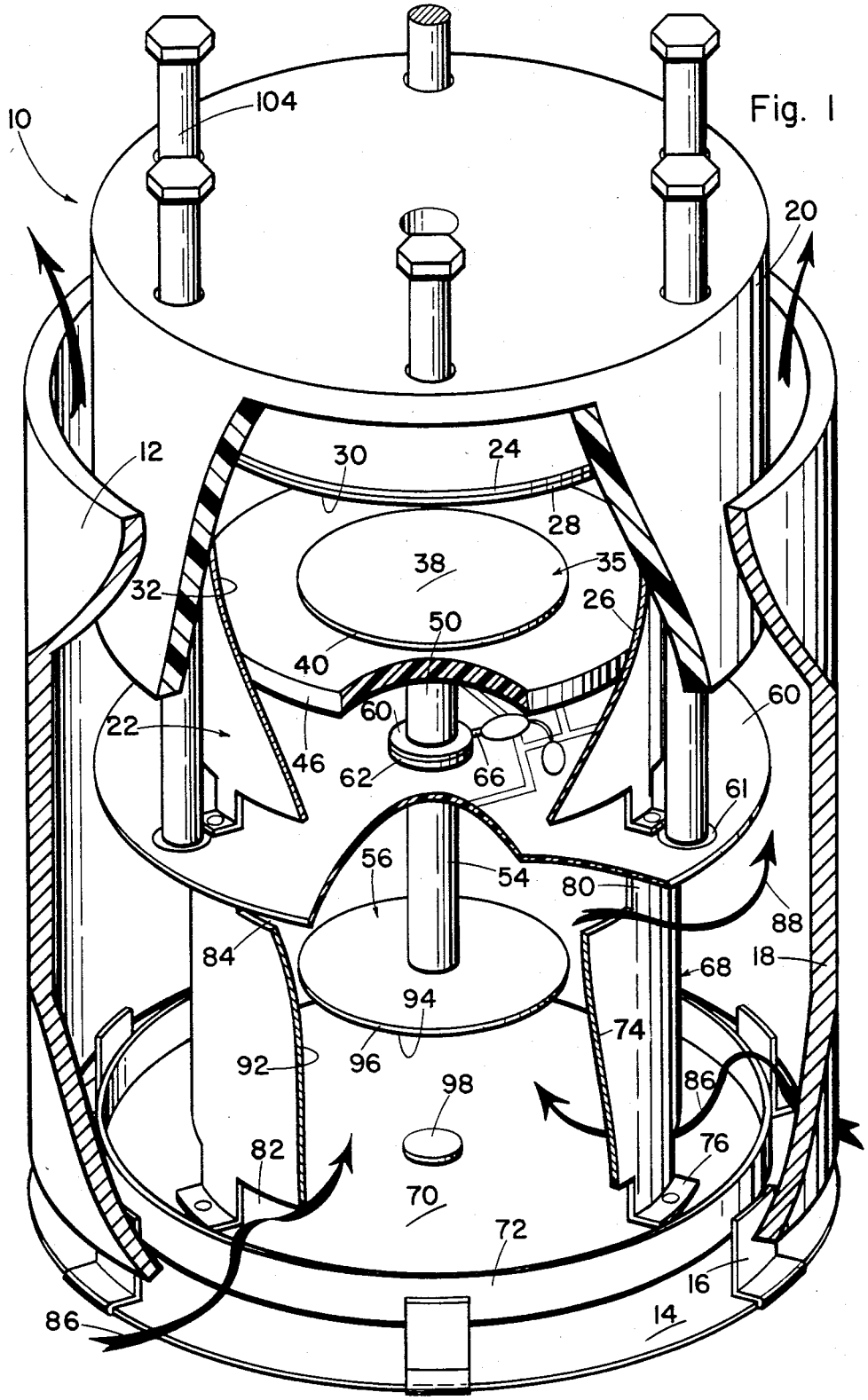
FIG. 1, a perspective view of a preferred embodiment with cut away portions revealing the construction of the device.
Figure 2:
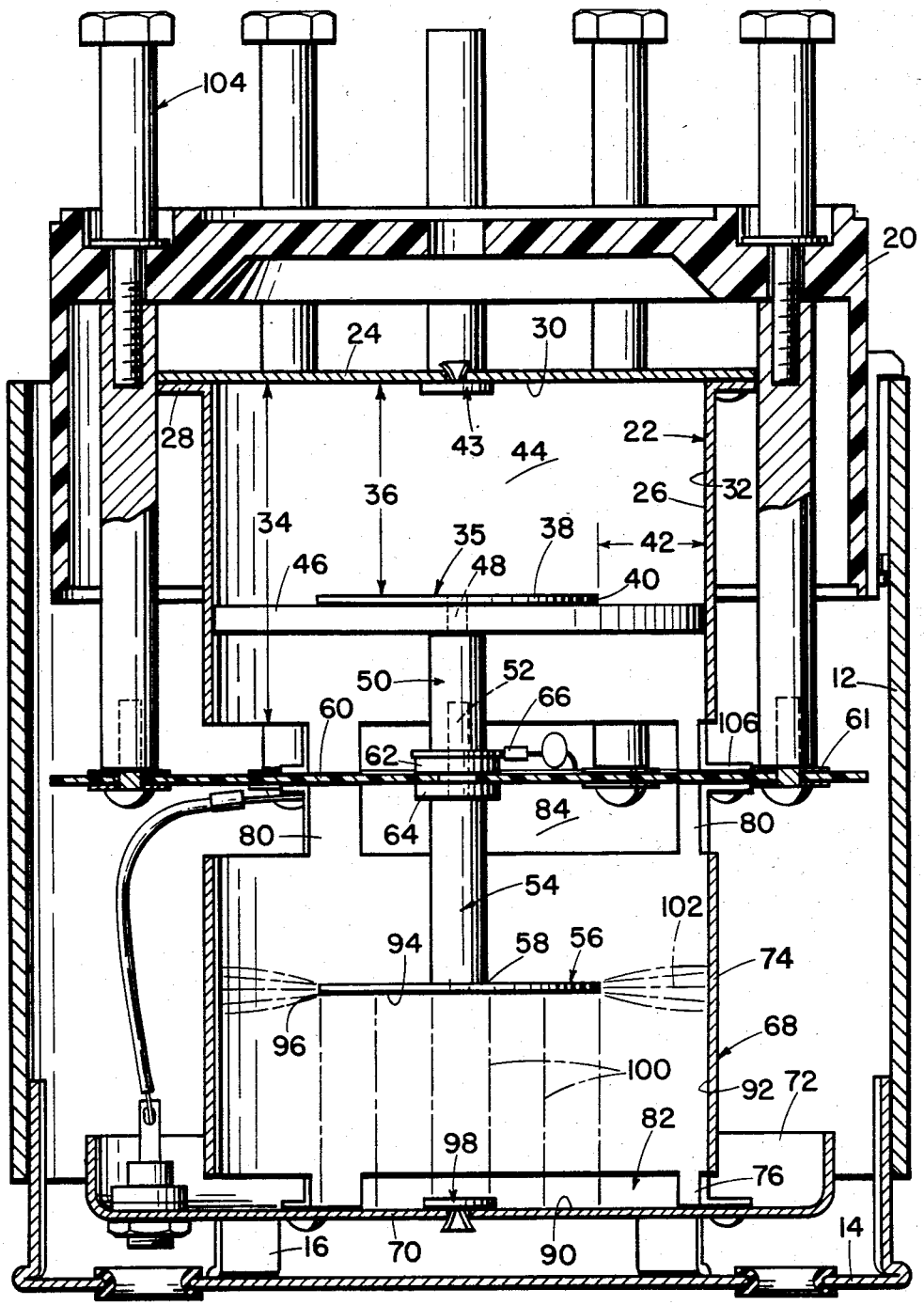
FIG. 2, an elevation view, in section, of the device of the present invention; and, FIG. 3, a schematic representation depicting the ionization currents which are created between co-operating, conductive surfaces of the device of FIGS. 1 and 2.

The reader is advised to refer to both FIGS. 1 and 2, as he proceeds with the following description. One or the other of these views will better facilitate his understanding depending on the particular reference element being described. Of course, the references numbers used in both figures, identify the same part.

The device disclosed, is, in particular, one used for detecting fires. As suggested later on, this is a particular application of the special, self compensating design disclosed. Aware of the broader potential of the disclosed device, the particular description herein will center on application of the device to fire detection. The device 10 has an outer housing which includes a cylindrical shell 12, capped by a housing end plate 14. The end plate includes a plurality of tabs such as 16, which are spot welded to the inside surface 18 of the shell 12. These housing members are typically fabricated from aluminum. The outer housing also includes a plastic base portion 20 which is also secured to the housing shell 12 by means not shown.

Within the housing there is located first and second ionization chambers. The first chamber 22 will be identified as the reference chamber.

In the preferred embodiment, the chamber includes a cylindrical, cup shaped member which is formed by end plate 24; and, cylindrical sidewall 26. The sidewall includes flanges shown typically at 28, which are used to secure it to the end plate-both physically and electrically. Typically, an eyelet or pop rivet is used to effect this fastening. The end plate and cylindrical sidewall, typically, are fabricated from stainless steel. This inherently provides a conductive surface 30 which is directed inwardly towards the volume contained by the cup profile. The conductive surface 30 is electrically connected to the inside conductive surface 32 of the cylindrical sidewall through the contact provided by the flanges 28. In the preferred embodiment, the thicknesses of the end plate 24 and cylindrical sidewall 26 are on the order of 0.015 inches.

The cylindrical sidewall for the embodiment disclosed extends a distance 34 of approximately 1.5 inches. Electrode disc 35 which lies in a plane substantially parallel to the plane of end plate 24 is positioned a distance 36 below the end plate as viewed in the figures. This distance, approximately 0.75 inches, is about halfway down the sidewall. The disc is likewise fabricated from stainless steel and is approximately 0.015 inches thick.

The disc includes a conductive disc edge face 40. For the embodiment shown, the disc diameter is 1.0 inches and the distance 42, between the inside sidewall surface 32 and the edge face 40, is approximately 0.388 inches. Disposed in the center of the end plate 24, on surface 30, is a radioactive source 43. This may be an alpha or beta particle source but, in the preferred embodiment, Americium 241, having a source activity of 0.5 microcurie is used. This source may be purchased from Nuclear Radiation Development Corporation of Grand Island, N.Y., and is identified as model A 1008. The activity of the source is selected in view of the cooperating surface areas of the end plate and disc, as well as the edge face and sidewalls; the volumes intervening between those pairs of surfaces and the distances therebetween. The activity of the source is such that a homogeneously, ionized condition exists in the volumes intervening the surfaces such that under appropriate voltage and current conditions, the electrical conductivity of the air in the intervening volumes is relatively constant. This results in certain linear relationships between voltage and current which are necessary to the sensitivity of the detection process.

The volume 44 is "sealed" to the external environment by insulating disc 46. This is manufactured from Teflon and is approximately 0.1 inches thick. It fits snugly within the cylinder formed by sidewall 26. Volume 44 is not completely sealed to the outside environment but can achieve a degree of stability in so far as the temperature and humidity of the surrounding medium. However, abrupt changes in the environs are not sensed, so that the chamber provides a reference against which such changes can be measured.

The electrode disc 35 is secured to the threaded end 48 of a stand off 50. The latter in turn is connected by threaded stem 52 to a second stand off 54 used for mounting the sample chamber electrode disc 56. The latter is secured to stand off 54 at end 58, again by a threaded member not pictorialized. The connecting pieces are all fabricated from metal such as nickel plated brass, resulting in each electrode disc being at the same electric potential when energized. Positioned at the junction of the stand offs 50 and 54, is an electronic component, mounting board 60. Typically, this would be a printed circuit component board. It is electrically insulated from the stand offs by insulating washers 62 and 64. A solder lug 66 is in electrical contact with the stand offs and provides a means for electrically connecting the stand offs to the circuit (not shown) which is laid out on the component board 60.

The second ionization chamber 68, the sample chamber, is likewise a cylindrical, cup shaped volume. It includes an end plate 70 which is part of dish shaped member 72. The chamber also includes a cylindrical sidewall 74 which has a plurality of flanges 76, securing the sidewall both physically and electrically to the end plate 70. (There is no reference numeral 78).

The sidewall 74 also includes a plurality of flanges 80 which secure it to the component board 60 where electrical contact is made with the power supply for the device as disclosed hereinafter.

The flanges 76 and 80 extend a sufficient distance beyond the sidewall 74 such that a plurality of openings, 82 and 84, are created around the perimeter of the sidewalls. This allows the surrounding air to flow into and exit from the volume enclosed between the sidewall, end plate, and disc. For the orientation of the detector as shown in FIGS. 1 and 2, the path of the surrounding air is indicated in FIG. 1 as entering the sample chamber along arrows 86; and, exiting from the chamber along the path delineated by arrow 88.

The disc shaped member 56, cylindrical sidewall 74 and end plate 70 are also fabricated from conductive material, for example, stainless steel. Each, again, is approximately 0.015 inches thick. As a result, inward directed surface 90 of end plate 70 is conductive; as is the inside surface 92 of sidewall 74.

The disc 56 lies in a plane which is substantially parallel to the plane of end plate 70. It includes a conductive disc face 94 and cylindrical conductive disc edge face 96. The disc is disposed along the longitudinal axis of the cylindrically shaped chamber such that disc face 94 is approximately the same distance from surface 90, 0.75 inches, as surface 38 is from surface 30 of the reference chamber end plate. Also the dimensions of the disc and radius of the cylindrical sidewall are substantially identical to those of the reference chamber. Thus the distance between the edge face 96 and the inside surface 92 of the sidewall is also equal to the corresponding dimension in the reference chamber. Secured to end plate 70 is a radioactive source 98. Practically, again, this source would be the same as the one used in the reference chamber as to type and activity. As noted above, the radioactive source results in a homogeneously ionized volume between surfaces 90 and 94; and between surfaces 92 and 96. In view of this for the dimensions of the disc and end plate, and the edge face and sidewall conductive surfaces, when the chamber is energized electrically, the ionization currents flowing between the cooperating surfaces (shown functionally by lines 100, 102) are substantially equal and orthogonal.

The chambers 22 and 68 are adapted so as to be energized electrically, typically by a D.C. voltage source. The latter is connected to the chambers through a pair of base pins such as at 104. These are metal pins which bring the power to the component board 60 where, printed circuit lands run the power to the various electrical circuit components on the board as dictated by the circuit design. Typically, the electronic circuitry would include a voltage regulator for steadying the input voltage to thus provide a more stable voltage for the electronic circuit. Typically, the plus side of that regulated voltage would be connected to the cylindrical side wall 26, and in turn the end plate 24 through the flange connection at 28. This is done by a printed circuit land which is in electrical contact with the flanges 106. The negative side of the D.C. power would be connected to the sample chamber's, cylindrical sidewall and end plate through the contacting of flanges 80 by the appropriate printed circuit land. The electrode disc 35 and 56, and the stand offs 50 and 54 connecting the two, sit at effectively a potential value midway between the voltage impressed across the cylindrical cups. This is under normal operating conditions.

An electrical connection is made between the discs at the point of the solder lug 66, with the input circuitry of, typically, a very high input impedance amplifier. The function of this circuit is to essentially monitor the voltage variations across the sample chamber due to the effects that a condition, such as fire, has on the air flowing through the sample chamber. The input impedance is high in order to avoid loading the effective impedance presented by the sample chamber.

The voltage variations sensed by the high input impedance amplifier reflect themselves as changes in the output voltage of the circuitry contained on the component board 60, indicating the presence of the condition for which the detector is designed. The output voltage changes will be conducted through appropriate electrical contacts made between printed circuit lands on the component board and other ones of the base pins 104. Such output signals can trigger alarm indicating devices such as a lamp; and/or be connected in circuit with a larger fire detection system such as the PRIORITY MATRIX SYSTEM marketed by the assignee of this application. The design of the electronic circuitry is known in the art and is not the subject of the present invention.

Figure 3:
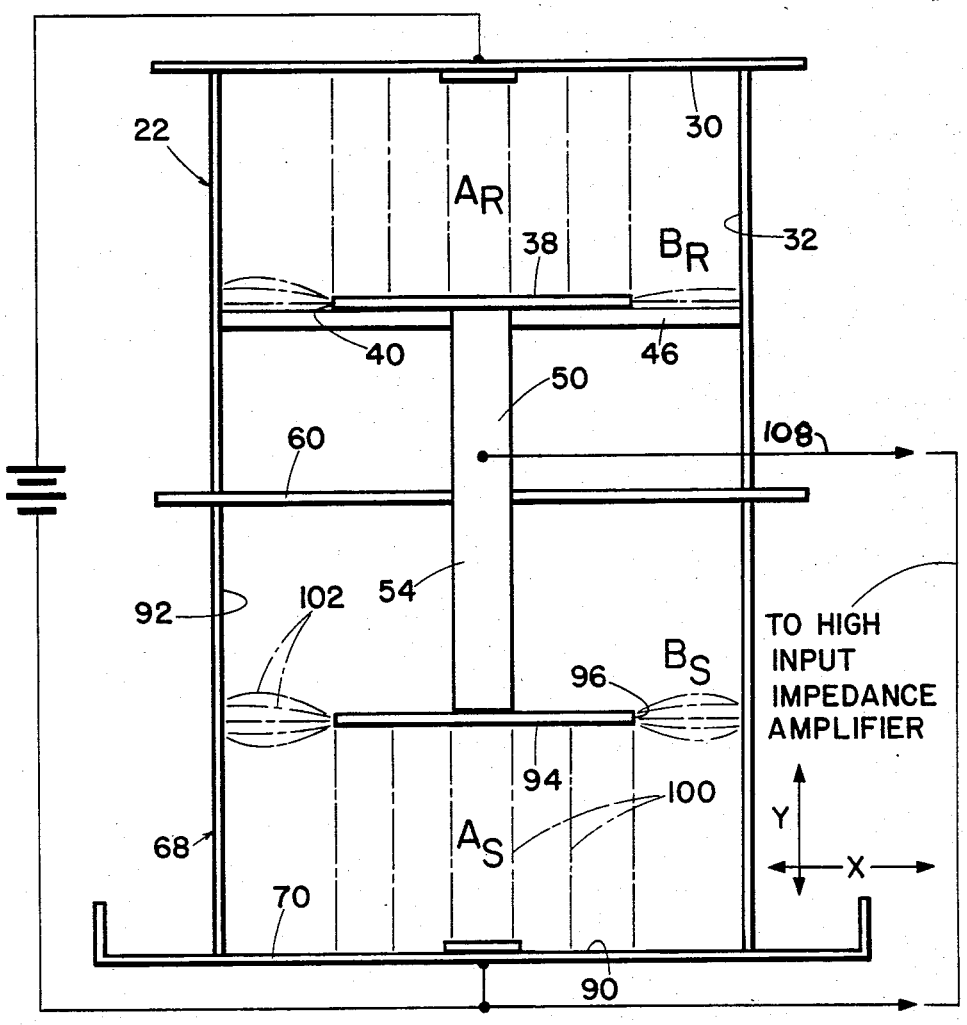

Referring now to FIG. 3, there is depicted a schematic representation of the reference and sample chambers. The subscript R is used to connote the reference chamber; while the subscript S identifies the sample chamber. The reference numerals shown are identical to those utilized in FIGS. 1 and 2, representing the same elements. A D.C. source is represented by the battery, the positive side of which is connected to the cylindrical portion of the reference chamber; the negative side being connected to the cylindrical portion of the sample chamber. Also, the negative or return of the D.C. power supply is extended to the right and is connected to the low side of the high input impedence amplifier. The junction of the electrode discs, is shown being connected to the high side of the high input impedance amplifier. The voltage on electrical lead 108, under normal operating conditions is essentially half of the potential represented by the D.C. battery.

As noted above, the currents represented by $A_R$ and $B_R$ are equal and orthogonal and represent the ionization currents in the reference chamber. Since this chamber is "sealed" to the outside environment, these typically are unaffected by air flow and the accumulation of dust and dirt. The current $A_R$ flows between surface 30 and surface 38 on the disc. The $B_R$ flows between the edge face 40 and the inside surface 32 of the cylindrical sidewall.

Under normal conditions, i.e. insubstantial gas flow through the sample chamber or no accumulation of dirt or dust, $A_S$, the ionization current flowing between surface 90 and 94 is equal to but orthogonal to current $B_S$ flowing between disc edge face 96 and surface 92 of the sample chamber, cylindrical sidewall. When air moves through the sample chamber, the effect will be that one current will be added to, while a subtraction will take place as to the other. More precisely, referring to the coordinate scheme depicted in FIG. 3, if air moves in the "X" direction it will add to the $B_S$ current; but have a reducing effect on the $A_S$ current. However, if the air moves in the "Y" direction it will reduce the $B_S$ current and result in an increase in the $A_S$ current. Because of the chamber dimensions, since the $A_S$ current is equal to the $B_S$ current absent air flow, the effect of air velocity is thus virtually cancelled.

In the event that one of the internal surfaces e.g. 90, becomes coated with dust or dirt, compensation for this condition occurs as follows. The sample chamber effectively is connected in series with the reference chamber across the D.C. power source. The accumulation of dust, for example on surface 90, reduces the current $A_S$ between surfaces 90 and 94 effectively increasing the voltage potential between the surface 90 and disc face 94. This increase in voltage causes a corresponding increase in the ionization current, in this illustration $B_S$, along the unaffected current path. This increase in the $B_S$ current offsets the decrease in the $A_S$ current, thus compensating for the effects of the dust accumulation.

The development of equal current paths is accomplished through the adjustment of the physical dimensions of the chamber. Although equal and orthogonal current paths are most easily created by the disc within the cylindrical cup geometry, other geometries will work. For example, a cylinder comprised of a cylindrical pin within a hemisphere or cylindrical cup will also work provided the dimensions are calculated to provide two, orthogonal and equal current paths.

To illustrate the effects of geometry on the principles embodied by the present invention, consider the following. The subsequent calculations presume that the volumes between the respective pairs of conductive surfaces are unsaturated and homogeneously ionized by the radioactive source and that the voltage and current levels are such that the conductivity of the ionized air in the chamber is relatively constant. In a word, the chamber dimensions must be such that the current versus chamber dimension curve is linear. If this is the case, then the ratio of orthogonal currents is equal to the ratio of the volume of the first current path divided by its length to the volume of the second current path divided by its length. Thus:

$$\frac{I_A}{I_B} = \frac{V_A/d_A}{V_B/d_B}$$

Where $I_A$ and $I_B$ are the currents through the current paths A and B; $V_A$ and $V_B$ are the intervening volumes for each current path; and $d_A$ and $d_B$ are the distances between the cooperating surfaces. In the preferred embodiment, the current path A is a cylinder with a radius of one half the electrode disc diameter and a height equal to the distance between the electrode disc and the end plate of the chamber. Current path B assumes the shape of a toroid with a parabolic cross section. Although difficult to calculate without an equation for the electric field in the chamber, the limits on the volume for path B can be easily calculated. That is because the parabola will have an area larger than that of an isosceles (45°) triangle but smaller than that of a semi circle. Thus, suitable chamber dimesions can be generated with the following inequality:

$$\pi \frac{d^2_B[(d_b + r)^2 - r^2]}{d_B} \leqq \pi \frac{r^2 d_A}{d_A} \leqq \pi^2 \frac{d^2_B[(d_B + r)^2 - r^2]}{d_B}$$

Where $d_B$ is the distance between edge face 96 and the chamber sidewall face 92; r is the radius of the electrode disc 56; and, $d_A$ is the distance between surface 90 and electrode face 94. The actual dimensions of the chamber must be adjusted so that the above inequality is satisfied. If so, then the currents for this embodiment will be equal and orthogonal.

Other embodiments effecting the principles of the present invention may become apparent in view of the above description. Of course, the breadth of the present invention is not to be construed as limited to the disclosed embodiment, but considered to encompass those other embodiments that are within the spirit of the invention and covered by the appended claims.

What is claimed is:

1. A self compensating device employing ionization principles, for responding to alterations in the condition of the gas medium in the environment in which the device is placed comprising:

(a) an ionization chamber including a first member having first and second conductive surface portions, and a second member having third and fourth conductive surface portions;

(b) means for ionizing the gas within the chamber, said means placed physically in relation to the first, second, third, and fourth surface portions so as to create a substantially linear, ionization condition in the volume between respective pairs of said surface portions;

(c) means for creating a first electric field between a first pair of said surface portions consisting of said first and third surface conductive portions whereby a first ionization current flows substantially between said first and third surface conductive portions only; and (d) means for creating a second electric field between a second pair of said surface portions consisting of said second and fourth surface conductive portions whereby a second ionization current flows substantially between said second and fourth surface conductive portions only;

the area dimensions of the first and third surface portions and the second and fourth surface portions, the respective intervening volumes and distances there between, and the relative orientation of the surface pairs calculated and placed such that said first ionization current substantially equals in magnitude said second ionization current, and such that said first ionization current is axially orthogonal to said second ionization current;

said ionization chamber including openings whereby the surrounding gas medium can enter the chamber and pass through said intervening volumes.

2. A system employing ionization principles, for responding to alterations in the condition of a gas medium in the environment in which the device is placed, the system including means for self compensating for gas flow through the system and accumulation of dirt and dust therein, comprising:

(a) a first ionization chamber including a first member having first and second conductive surface portions, a second member having third and fourth conductive surface portions, (b) a second ionization chamber including a third member having fifth and sixth conductive surface portions, a fourth member having seventh and eighth conductive surface portions, (c) means for ionizing the gas within each of the first and second ionization chambers, said means placed physically in relation to the conductive surface portions, so as to create a substantially linear ionization condition in the intervening volumes between respective pairs of said surface portions in each of the first and second chambers, (d) means for creating a first electric field between a first pair of said surface portions consisting of said first and third surface conductive portions whereby a first ionization current flows substantially between said first and third surface conductive portions only; and (e) means for creating a second electric field between a second pair of said surface portions consisting of said second and fourth surface conductive portions whereby a second ionization current flows substantially between said second and fourth surface conductive portions only;

(f) means for creating a third electric field between a third pair of said surface portions consisting of said fifth and seventh surface conductive portions whereby a third ionization current flows substantially between said fifth and seventh surface conductive portions only; and (g) means for creating a fourth electric field between a fourth pair of said surface portions consisting of said sixth and eighth surface conductive portions whereby a fourth ionization current flows substantially between said sixth and eighth surface conductive portions only;

the area dimensions of the respective pairs of conductive surface portions, the respective intervening volumes and distances there between, and the relative orientation of the respective pairs calculated and placed such that said first ionization current substantially equals in magnitude said second ionization current, and such that said first ionization current is axially orthogonal to said second ionization current, and further such that said third ionization current substantially equals in magnitude said fourth ionization current, and such that said third ionization current is axially orthogonal to said fourth ionization current, said second ionization chamber including openings whereby the surrounding gas medium can enter the chamber and pass through said intervening volumes.

3. A device employing ionization principles, for responding to alterations in the condition of a gas medium in the environment in which the device is placed, the device including means for self compensating for gas flow through the device and accumulation of dirt and dust therein, comprising:

(a) a housing;

(b) a first ionization chamber disposed within said housing including a first member having first and second conductive surface portions, and a second member having third and fourth conductive surface portions;

(c) a second ionization chamber disposed within said housing including a third member having fifth and sixth conductive surface portions, and a fourth member having seventh and eighth conductive surface portions;

(d) means for ionizing the gas within each of the first and second ionization chambers, said means placed physically in relation to the conductive surface portions, so as to create a substantially linear ionization condition in the intervening volumes between respective pairs of said surface portions in each of the first and second chambers, (e) means for creating a first electric field between a first pair of said surface portions consisting of said first and third surface conductive portions whereby a first ionization current flows substantially between said first and third surface conductive portions only; and (f) means for creating a second electric field between a second pair of said surface portions consisting of said second and fourth surface conductive portions whereby a second ionization current flows substantially between said second and fourth surface conductive portions only;

(g) means for creating a third electric field between a third pair of said surface portions consisting of said fifth and seventh surface conductive portions whereby a third ionization current flows substantially between said fifth and seventh surface conductive portions only; and (h) means for creating a fourth electric field between a fourth pair of said surface portions consisting of said sixth and eighth surface conductive portions whereby a fourth ionization current flows substantially between said sixth and eighth surface conductive portions only;

the area dimensions of the respective pairs of conductive surface portions, the respective intervening volumes and distances there between, and the relative orientation of the respective pairs calculated and placed such that said first ionization current substantially equals in magnitude said second ionization current, and such that said first ionization current is axially orthogonal to said second ionization current, and further such that said third ionization current substantially equals in magnitude said fourth ionization current, and such that said third ionization current is axially orthogonal to said fourth ionization current, said housing and said second ionization chamber including openings whereby the surrounding gas medium can enter the chamber and pass through said intervening volumes.

4. The device claimed in either claims 1, 2, or 3, wherein the means for ionizing the gas within each chamber is an alpha particle source.

5. The device claimed in either claims 1, 2, or 3, wherein for each ionization chamber, set forth, one of said members comprises a cylindrically shaped cup, one of said conductive surfaces for said cup comprising the inward directed surface of the end plate of said cup, the other said conductive surface for said cup comprising the inside surface of the cylindrical sidewall, the second of said members comprising a disc, one of said conductive surfaces for said disc comprising a face of said disc, the other conductive surface for said disc comprising the edge face.

6. The device claimed in claim 5, wherein the means for ionizing the gas within each chamber is an alpha particle source.

7. The device claimed in claim 6, wherein the alpha particle source is disposed on the inward directed surface of the end plate of each respective cup.

8. A fire detection device employing ionization principles, the device including means for self compensating for the effects of airflow through the device and the accumulation of dirt and dust, therein, comprising:

(a) a first ionization chamber including a first cylindrically shaped cup, having an end plate including an inwardly directed conductive surface and a cylindrical sidewall having a conductive inside surface, and a disc disposed in a plane parallel to the plane of said end plate and positioned a predetermined distance therefrom, said disc including, a conductive disc face facing the inwardly directed conductive surface, and a cylindrical conductive edge face;

(b) a second ionization chamber including a second cylindrically shaped cup, having an end plate including an inwardly directed conductive surface and a cylindrical sidewall having a conductive inside surface and a disc disposed in a plane parallel to the plane of said end plate and positioned a predetermined distance therefrom, said disc including, a conductive disc face facing the inwardly directed conductive surface and a cylindrical conductive edge face;

(c) an alpha particle source disposed on each end plate whereby the air in the intervening volumes between the respective conductive surfaces is linearly ionized;

(d) means for creating a first electric field between the inwardly directed conductive surface of said first ionization chamber end plate, and the conductive disc face of said first ionization chamber disc whereby a first ionization current flows substantially between said end plate inwardly directed conductive surface and said disc face;

(e) means for creating a second electric field between the conductive inside surface of said first ionization chamber cylindrical side wall, and the cylindrical edge face of said first ionization chamber disc whereby a second ionization current flows substantially between said conductive inside surface of said cylindrical side wall and said cylindrical conductive edge face;

(f) means for creating a third electric field between the inwardly directed conductive surface of said second ionization chamber end plate, and the conductive disc face of said second ionization chamber disc whereby a third ionization current flows substantially between said second chamber end plate inwardly directed conductive surface and said second chamber disc face;

(g) means for creating a fourth electric field between the conductive inside surface of said second ionization chamber cylindrical side wall, and the cylindrical conductive edge face of said second ionization chamber disc whereby a fourth ionization current flows substantially between said conductive inside surface of said second chamber cylindrical side wall and said chamber, cylindrical conductive edge face;

the area dimensions of the respective pairs of conductive surface portions, the respective intervening volumes and distances there between, and the relative orientation of the respective pairs calculated and placed such that said first ionization current substantially equals in magnitude said second ionization current, and such that said first ionization current is axially orthogonal to said second ionization current, and further such that said third ionization current substantially equals in magnitude said fourth ionization current, and such that said third ionization current is axially orthogonal to said fourth ionization current, said second ionization chamber including openings whereby the surrounding air can enter the chamber and pass through said intervening volumes.

* * * * *